United States Patent [19]

Wong

[11] Patent Number: 4,987,348

[45] Date of Patent: Jan. 22, 1991

[54] BILEVEL CURRENT LIMITER

[75] Inventor: Stephen L. Wong, Scarsdale, N.Y.

[73] Assignee: North American Philips Corporation, New York, N.Y.

[21] Appl. No.: 452,092

[22] Filed: Dec. 15, 1989

[51] Int. Cl.[5] ..... H05B 39/04

[52] U.S. Cl. ..... 315/307; 315/308

[58] Field of Search ..... 315/291, 297, 301, 307, 315/308

[56] References Cited

U.S. PATENT DOCUMENTS 4,417,183 11/1983 Popard et al. ..... 315/291
4,739,226 4/1988 Murata ..... 315/307 X

FOREIGN PATENT DOCUMENTS 3037957 12/1983 Fed. Rep. of Germany .
0285417 5/1988 United Kingdom .

OTHER PUBLICATIONS

"The Design of a High Power Solid State Automotive Switch In CMOS-VDMOS Technology"; Robert S. Wrathall; 1985 IEEE; pp. 229-232.

*Primary Examiner*—David Mis

*Attorney, Agent, or Firm*—Bernard Franzblau

[57] ABSTRACT

A bilevel current limiting control circuit which enables a semiconductor controlled power switch with a limited power handling capability to operate near the inside border of the safe operating area (SOA) characteristic of the power switch. The control circuit is especially useful in limiting the turn-on inrush surge current to an incandescent lamp load supplied via the semiconductor power switch. The control circuit includes a series circuit made up of the power switch, a current sensing resistor and a lamp load connected to the terminals of a source of supply voltage. First and second comparison circuits, arranged to provide first and second different current limits for the control circuit, are connected to the sensing resistor. A third comparison circuit compares the load voltage with a reference voltage to control a selector device that selects the output of the first or second comparison circuit as a function of the level of the load voltage. The output of the selected comparison circuit is applied via a feedback circuit to a control electrode of the power switch so as to control the load current to the first and second current limit values as selected in response to the load voltage.

7 Claims, 2 Drawing Sheets

BILEVEL CURRENT LIMITER

BACKGROUND OF THE INVENTION

This invention relates to a control circuit for controlling and limiting via a semiconductor control switch the start-up current supplied to a load in two or more steps and in a manner so as to protect the semiconductor control switch from overload. More particularly, the present invention relates to a control circuit, for limiting the start-up current that flows through a semiconductor control switch connected in series circuit with an incandescent lamp or similar load device whose impedance exhibits a non-linear variation during the turn-on phase thereof.

Due to the non-linear impedance characteristic of an incandescent lamp or other similar non-linear impedance load, a turn-on or inrush surge current occurs which may be approximately ten times the steady state or normal operating current of the lamp or other load. If a semiconductor control device, such as a bipolar transistor or a field effect transistor (FET), is connected in series circuit with such a load across a pair of voltage supply terminals, damage to the semiconductor control device may occur at start-up unless some form of surge current protection is provided.

For energizing a lamp, one known and common constant current limiting technique is shown in FIG. 1 and includes a semiconductor power switch 1, such as an FET, connected in series circuit with a small sensing resistor 2 and the lamp 3 across a pair of voltage supply terminals. The voltage developed across the sensing resistor ($R_s$), which is proportional to the current through the FET and the lamp, is applied to an input of a comparator 4 having a fixed input offset voltage ($V_{os}$). The output of the comparator is coupled via a logic circuit 5 and a switch driver 6 to the gate or control electrode of the series connected power switch (FET). If the load current flowing through $R_s$ is large enough to trigger the comparator, a feedback signal is applied to the gate or control electrode of the FET via the logic circuit and the switch driver so as to turn-off the power switch. Assuming the feedback delay is small compared to the rise/fall time of the power switch (FET), the load current will be limited to a constant value (possibly with a small ripple component) equal to $V_{os}/R_s$.

FIG. 1A depicts the relationship of load current ($I_L$) versus the output voltage ($V_o$) across the lamp for the lamp control circuit described above. Also shown is the characteristic curve $T_c$ for the transistor power switch which defines the safe operating area (SOA) for the series connected FET power switch. The curve labelled TOC represents the turn-on characteristic for the incandescent lamp and shows the variation of the operation points during turn-on of the lamp as it heats up and its filament resistance increases continuously from a small resistance value $R_c$ when it is cold to a final steady state value $R_h$ after it has heated up.

In this type of prior art circuit, the current is initially limited to a value $I_{L1}$. If, during the time that the power switch drives the lamp, part of the TOC of the lamp remains outside of the SOA of the power switch for a sufficient period of time, for example, from the time instant $t_1$ to the time instant $t_2$, damage to or destruction of the power switch may result due to overload thereof.

There are three common methods for protecting the power switch from overload during start-up of the lamp. The first is to reduce the current limit value from the value $I_{L1}$ to a lower value $I_{L2}$, where $I_{L2}$ is now the maximum current allowed to flow and its value is chosen so that the current through the power switch never exceeds its power capability over the entire operating range of the load current and the load voltage. A disadvantage of this technique is that the small current flowing during start-up means less power is delivered to the load (lamp) and so the lamp will heat up and reach its normal operating resistance at a much slower rate.

A second switch protection method is to use a power switch with a much higher power handling capability such that it can safely handle the maximum lamp current which occurs when the filament is cold. This method has the obvious disadvantage that it requires a much larger power switch, a larger heat sink, etc, all of which increases the cost and size of the circuit.

A third way of protecting the power switch is to switch it on and off at a low duty cycle during the initial time period when the lamp resistance is low thereby to reduce the power dissipation in the switch. One disadvantage of this approach is that the power pulses generated produce undesirable electromagnetic interference (EMI).

European patent application, EPA No. 0,285,417, published Oct. 5, 1988 discloses a solid state switch for limiting the flow of start-up current to an incandescent lamp. The control circuitry in this device initially allows a relatively low constant current to flow through the lamp and a series connected FET switch and then, automatically, after the lamp resistance reaches a preselected level, it is allowed to draw a significantly higher current. The size and cost of the power FET is reduced significantly because the magnitude of the current spike generated at turn-on of the lamp is reduced. A disadvantage of this circuit is that effectively it provides only one current limit. When it switches over automatically, a fairly large current spike nevertheless is still allowed to flow, albeit lower than would otherwise occur in the absence of the invention described therein. Furthermore, that device uses operational amplifiers to bias the current delivered to the lamp, rather than comparators operative to clamp the current to a certain value. As a result, the EPA apparatus requires frequency compensation and is therefore harder to implement in an integrated circuit.

The foregoing problems related to the operation of a lamp load are compounded in the case of an automotive environment which requires special techniques to drive an automotive lam load.

SUMMARY OF THE INVENTION

It is therefore an object of the invention to provide a control circuit for turning on and operating an incandescent lamp or similar type load by means of a power transistor in which two separate current limits are selected which track the SOA boundary of the transistor characteristic thereby allowing a maximum current to flow during turn-on of the lamp and without exceeding the safe operating current limits of the power transistor.

Another object of the invention is to provide a two-level current limiting apparatus which monitors the SOA of a power transistor and which allows an incandescent lamp load or the like to turn on quickly, reliably and without the generation of electromagnetic interference or a current surge at the switchover point.

A further object of the invention is to provide a bilevel current limiting control circuit for turning on a load via a power transistor having a limited power handling capability such that it maximizes the current delivered to the load without exceeding the SOA limit of the power transistor and without using pulses.

A still further object of the invention is to provide a bilevel current limiting control circuit that is especially useful for safely driving a lamp load in an automobile.

The above and other objects are achieved by means of an apparatus that includes a power transistor (e.g. an FET), all or a part of which is connected in series circuit with a current sensing device (e.g. a small resistor) and an incandescent lamp load or the like across a pair of power supply terminals. First and second comparators with first and second separate trigger levels have their inputs coupled to the current sensing device thereby providing two separate current level limits. The outputs of the comparators are coupled via a selector circuit to a control circuit whose output is coupled via a switch driver to a gate or control electrode of the power transistor to control the current flow therein. A third comparator has an input coupled to the load and an output coupled to a control input of the selector circuit whereby either the output of the first or second comparator is selected depending on the level of the load voltage. This bilevel current limiting feature enables a power transistor with a limited power capability to operate near the inside border of its SOA during turn-on of the lamp load thereby providing rapid lamp turn-on without damage to the power transistor and without the generation of electromagnetic interference or current spikes.

The invention broadly operates to automatically change the current delivered to an incandescent lamp load or the like depending on the lamp (load) voltage in a manner such that the power switch (transistor) is protected from the initial current surge during turn-on. The invention is based on the concept of monitoring the safe operating area (SOA) of the power switch. More particularly, by means of the invention, an active current limit circuit supplies a current that is constrained to remain near, and preferably within, the boundary of the SOA of the semiconductor power switch so that an optimal level of current is delivered to the load while simultaneously protecting the power switch from excessive currents and thereby possible damage. The invention provides two separate current limits automatically selected to track the SOA boundary whereby the maximum safe current is delivered to the lamp during all phases of the turn-on operation. The invention thus make it possible to safely deliver more current to the power switch than prior art devices that do not use the principle of monitoring the SOA of the power switch.

Another distinction between the invention and, for example, the solid state switch described in EPA No. 0,285,417 A2 is that the EPA device uses operational amplifiers to continuously bias the current supplied to the load, whereas the invention uses comparators which operate to clamp the current to a certain value. This provides the advantage of ease of implementation in certain high voltage processes, and also avoids the requirement for frequency compensation in the op-amps, a potential source of instability.

BRIEF DESCRIPTION OF THE DRAWINGS

The invention will now be described in greater detail in connection with the accompanying drawings in which.

DESCRIPTION OF THE PREFERRED EMBODIMENTS

Figure 1:
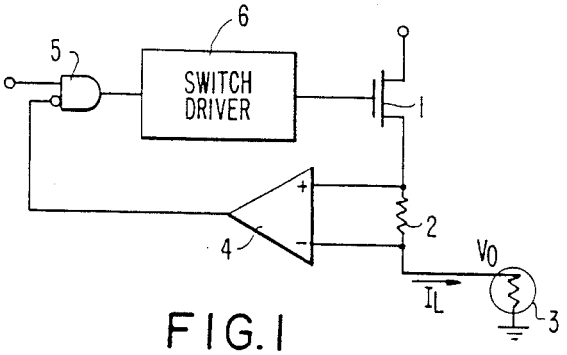
FIG. 1 PRIOR ART
FIG. 1 is a block-schematic diagram of one form of a conventional current limiter circuit for a lamp load.
Figure 1A:
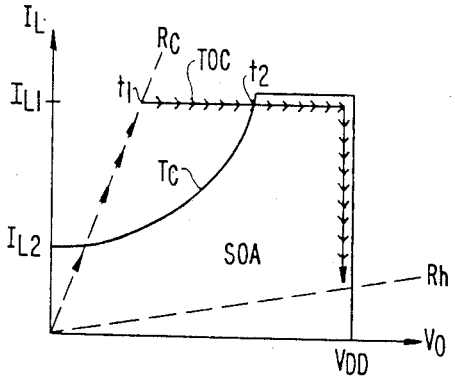
FIG. 1A shows the relationship between load current and load voltage for the current limiter circuit of FIG. 1.
Figure 2:
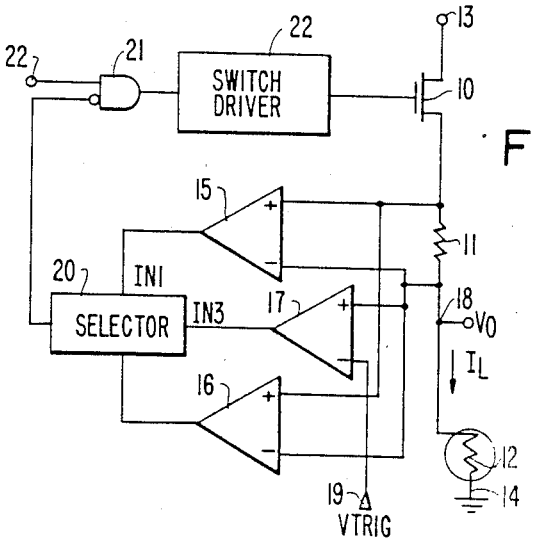
FIG. 2 shows a block-schematic diagram of a preferred embodiment of the invention.

FIG. 2 shows a block-schematic diagram of a preferred embodiment of the invention which comprises a semiconductor power switch 10, for example, a field-effect transistor (FET) connected in whole or in part in series circuit with a sensing resistor 11 and a load 12, for example, an incandescent lamp, across the terminals 13, 14 of a source of DC supply voltage. Terminal 14 may be connected to ground.

The resistor 11 senses the load current, $I_L$, and develops a voltage proportional thereto. The terminals of the sensing resistor are coupled to the input terminals of a first comparator 15 and to a second comparator 16 so that the voltage developed across the resistor, which is proportional to the load current, is operative to control the operation of the comparators. The comparators 15 and 16 have different levels of internal offset voltages $V_{os1}$ and $V_{os2}$ which operate as reference voltages to determine the switching points of their respective comparators and thereby set the first and second current limits of the control circuit.

Figure 4:
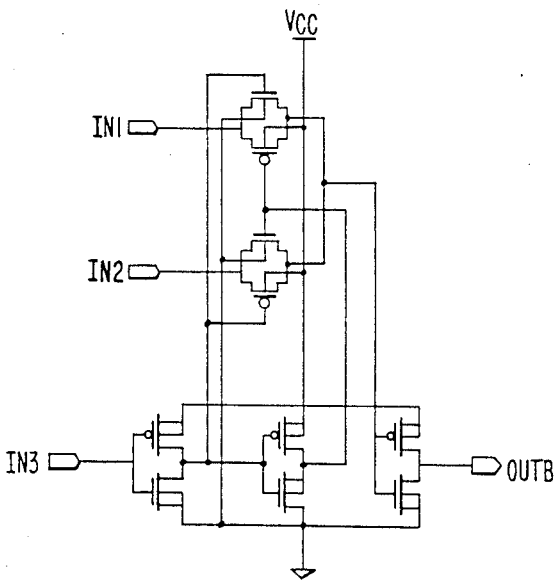
FIG. 4 is a circuit diagram of a selector device for use in the apparatus of FIG. 2.

A third comparator 17 has one input (+) connected to the load terminal 18 at which the load voltage($V_0$) appears, and has a second input (−) connected to an input terminal 19 which receives a reference voltage, $V_{trig}$. The output terminals of the first, second and third comparators are connected to first, second and third input terminals of a selector device 20, which may be a conventional multiplexor circuit, one form of which is shown in FIG. 4. In FIG. 4, the selector function is implemented using two bidirectional CMOS switches and three inverters. The operation thereof is well known and will therefore not be set forth in further detail.

The output of the selector 20 is in turn connected to one input of a logic circuit 21. A second input of the logic circuit is connected to an input terminal 22 which receives a signal for turning the control circuit on. The output of gate circuit 21 is connected to an input of a conventional switch driver stage 22 having an output connected to the gate or control electrode of the power switch 10 in order to control the conduction of the switch.

Figure 3:
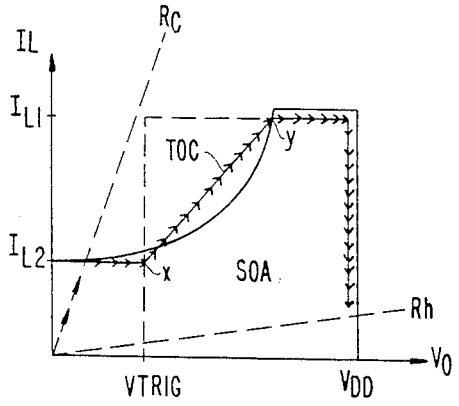
FIG. 3 shows the relationship between load current and load voltage for the current limiter circuit of FIG. 2 showing the SOA and the TOC.

As shown in FIG. 3, when the current limiter of FIG. 2 is first turned on, the resistance of the lamp load 12 is initially low, i.e. it has a cold resistance $R_c$, which establishes a first load line ($R_c$) for the lamp element 12. After the current flows through the load for a sufficient time period, the lamp heats up so that the resistance thereof reaches its normal operating value, $R_h$. This establishes the load line $R_h$ shown in FIG. 3. Between the initial (cold) and final (hot) resistance values, the lamp resistance increases so that a multiplicity of load lines (not shown) are established. The load lines effectively rotate clockwise from the resistance value $R_c$ up to the resistance value $R_h$.

The third comparator 17 is responsive to the load voltage $V_o$, which increases as the lamp heats up and its resistance increases. The third comparator operates via the selector device 20 to select the output from either the first comparator 15 or the second comparator 16 depending on whether the output voltage, $V_o$ is greater or smaller than the reference voltage, $V_{trig}$, at the input terminal 19. The selected output provides a feedback to the gate of the power switch so as to control the state of the power switch 10. When $V_o < V_{trig}$, the output of the comparator 15 is selected, whereby the reference voltage, $V_{os1}$, of this comparator sets the current limit for the series circuit (10-12) to a low load current value $I_{L2}$, as shown in FIG. 3. Therefore, initially, the feedback circuit operates to limit the load current flowing through the power switch 10 to a value $I_{L2}$ which lies within and close to the boundary of the safe operating area (SOA) for this transistor.

As the lamp resistance increases, a point X on the lamp turn-on characteristic (TOC) is reached at which the output load voltage, $V_o$, just exceeds the value of the reference voltage $V_{trig}$. At this point, the third comparator and selector operate to select the output of the second comparator 16 in place of the output of the first comparator 15. The offset reference voltage, $V_{os2}$, of the second comparator now sets the current limit, via the feedback circuit coupled to the gate of power FET 10, to a higher value, $I_{L1}$ shown in FIG. 3.

The lamp now heats up faster and its resistance follows the portion of the TOC between points X and Y. As can be seen in FIG. 3, the load current in the FET 10 closely follows the boundary of the SOA of the transistor between points X and Y. Although the transistor current slightly exceeds the SOA boundary between points X and Y, it will not damage the transistor since the transition period X-Y is very brief so that the transistor does not have time to overheat.

Alternatively, the value of the reference voltage $V_{trig}$ can be selected so that the point X occurs at a later point in time (to the right in FIG. 3) such that the TOC between points X and Y lies wholly within the boundary of the SOA of the transistor. The choice of $V_{trig}$ in FIG. 3 has the advantage that the lamp heats up a little quicker, also without damage to the power switch 10. By selecting a value of trigger voltage such that $V_{trig} = -(I_{L2}/I_{L1})(V_{DD} - P_o/I_{L1})$, where $V_{DD}$ is the supply voltage and $P_o$ is the maximum power limit of the switch 10, the TOC will remain within the SOA boundary of the switch and at the same time will provide close to the maximum available load current at all times during the lamp turn-on phase. The result is quick turn-on of the lamp, no damage to the power switch, and no EMI generated.

The invention described has been implemented and fabricated on a silicon chip as a special feature of an intelligent power switch for use in automobiles. Appropriate offset voltages were chosen to determine the two current limits for the bilevel control circuit. The circuit was tested for three different values of load resistance. Current limiting was achieved by turning the power switch on and off about a nominal current. The on/off command was given by the output of the selector switch.

The circuit waveforms were displayed on an oscilloscope and showed the load voltage, $V_O$, tracking the increase in the value of the load resistance with time. A slight discontinuity was observed in the load voltage waveform at a load voltage of 8 volts, which was the value chosen for $V_{trig}$. This is the point in time when the selector switched over from the first comparator to the second comparator, changing the current limit to a higher value (about 20% in the test). This allowed more current to be delivered to the lamp when the drain-to-source voltage of the power FET was low. The corresponding waveform of the gate voltage of the power FET showed a relatively small step increase at the switchover point, $V_{trig}$, and then increased approximately linearly to a final constant value. Controlled current limiting was achieved over the entire range of output voltage. The values of the current limits and the transition voltage can be set, as desired, by the user.

The foregoing description sets forth my concept of a bilevel current limiting method and apparatus for monitoring a semiconductor power device by reference to the safe operating area of the power device. Important advantages are that the control circuit provides an active current limit which clamps the current to first and second maximum values independently of the load, and there is practically speaking no current spike generated at the transition from one current limit value to the next.

The above description presents an exemplary embodiment of the invention which is illustrative of the spirit and scope thereof. Various modifications can be made consistent with the principles of the invention. The invention is not limited, for example, for use with an incandescent lamp load, but other types of load consistent with the above description come within the scope of the invention. It should therefore be understood that the invention is to be limited only by the scope of the accompanying claims.

I claim:

1. A control circuit for energizing an electric load comprising:

input terminals for supplying a source of electric current to the load, a controlled semiconductor power device having a characteristic that defines a safe operation area (SOA) of the semiconductor power device, current sensing means, means for coupling at least a part of said semiconductor power device, said current sensing means and said load in series circuit across said input terminals, means coupled to said current sensing means for setting first and second current limits for the control circuit, each of which is set near to the boundary of the SOA of said semiconductor power device, means controlled by a voltage developed at said load for selecting said first and second current limits as a function of the level of the load voltage, and means coupled to a control electrode of the semiconductor power device and controlled by said setting means for controlling and limiting the current passed by said semiconductor power device to the load as a function of the current limit selected in response to the load voltage.

2. A control circuit as claimed in claim 1 wherein said selecting means comprises a comparison circuit having a first input coupled to a terminal of the load and a second input that receives a reference voltage that determines the voltage level at which switchover occurs between said first and second current limits.

3. A control circuit as claimed in claim 2 wherein said setting means comprises second and third comparison circuits controlled by a voltage developed across said current sensing means, output signals of said second and third comparison circuits being selected at mutually exclusive times by the first comparison circuit.

4. A control circuit as claimed in claim 3 wherein said controlling and limiting means comprise a feedback circuit coupled between outputs of the second and third comparison circuits and the control electrode of the semiconductor power device and including a logic circuit and a driver circuit connected in cascade.

5. A control circuit as claimed in claim 1 wherein said load includes an incandescent electric lamp.

6. A control circuit as claimed in claim 1 wherein said current sensing means comprises a resistor with a relatively low resistance value.

7. A control circuit as claimed in claim 1 wherein said current limit setting means sets said first and second current limits so that each of said current limits falls within the SOA of said semiconductor power device.

* * * * *